United States Patent [19]

Scheidt et al.

[11] Patent Number: 4,545,754

[45] Date of Patent: Oct. 8, 1985

[54] APPARATUS FOR PRODUCING MOLDINGS FROM CONCRETE

[75] Inventors: Joachim Scheidt, Hiddenhausen; Gottfried Keller, Allmendingen, both of Fed. Rep. of Germany

[73] Assignee: Rampf Foreman GmbH, Allmendingen, Fed. Rep. of Germany

[21] Appl. No.: 588,641

[22] Filed: Mar. 8, 1984

[30] Foreign Application Priority Data

Mar. 11, 1983 [DE] Fed. Rep. of Germany ... 8307078[U]

[51] Int. Cl.[4] ..... B30B 11/02

[52] U.S. Cl. ..... 425/419; 425/412; 425/425; 425/431; 425/457

[58] Field of Search ..... 425/412, 419, 425, 431, 425/457

[56] References Cited

U.S. PATENT DOCUMENTS

| | | | |
|---|---|---|---|
| 2,228,246 | 1/1941 | Beyan | 425/195 |
| 2,292,410 | 8/1942 | Strong | 425/421 X |
| 3,712,785 | 1/1973 | Hirt et al. | 425/421 X |
| 3,932,100 | 1/1976 | Blindheim | 425/421 X |
| 4,157,887 | 6/1979 | Söthje | 425/412 X |

*Primary Examiner*—J. Howard Flint, Jr.
*Attorney, Agent, or Firm*—Spencer & Frank

[57] ABSTRACT

An apparatus for producing moldings (48) from concrete et cetera, particularly concrete paving stones, the top side of which exhibits partial surfaces of different vertical level, comprises a molding table (46), a molding frame (30, 31) and a stamp fitting in the latter. For better consolidation and in order to facilitate clean removal from the mold, it is provided that the stamp consists of two separate partial stamps (33, 42) guided in each other, the end cross-sectional surfaces of which are dimensioned so that the one (33) molds the lower-lying and the other (42) the higher-lying top partial surfaces of the molding (48) and that the stroke distance of the partial stamp (42) for the higher-lying partial surfaces is limited in an upper consolidation position, in which both partial stamps conjointly reproduce the top side of the molding, and in a lower mold-removal position, by stops. The partial stamp (33) for the lower-lying partial surfaces preferably consists of a ring surrounding the other partial stamp (42). This ring may be connected by guide bolts (35) to a first superimposed load (36), whereas the inner partial stamp (42) supports a second superimposed load in the form of a guide plate (44). For use in multi-layer production machines it is provided to lock the two partial stamps (33 and 42) intermittently together, particularly by means of locking elements (38) which engage automatically and can be disengaged by control lugs (32) of the molding frame (30).

8 Claims, 12 Drawing Figures

APPARATUS FOR PRODUCING MOLDINGS FROM CONCRETE

The invention relates to an apparatus for producing moldings from concrete et cetera, particularly concrete paving stones and lawn stepping stones, the top side of which exhibits partial surfaces of different vertical level, with a molding table, with a molding frame and with a stamp fitted in the latter, guided movably at right angles to the molding table and provided with a superimposed load.

Molding apparatuses of this type are known and operate as follows: First of all the molding frame resting upon the molding table is charged with a comparatively dry concrete mixture and skimmed. Then the stamp is lowered into the molding box, whilst the molding table and/or the superimposed load is subjected to a vibrating movement which promotes the consolidation of the concrete. The mold is then removed immediately, for which purpose the molding frame is raised, entraining the stamp after an initial stroke section.

Figure 1:
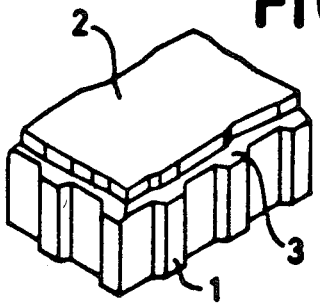

Difficulties were experienced in the production of the interlocking paving stone illustrated in FIG. 1. Its peculiarity lies in the fact that the face side is constructed in two steps, namely with a higher-lying central panel and with a lower-lying slightly outwardly sloping edge region. Due to the comparatively great difference in height between the partial surfaces mentioned, the consolidation in the transitional region between the central panel and the edge region was inadequate. It was also impossible to remove the molding from the mold cleanly, and the mold sections were inadequately cleaned.

The underlying aim of the invention is to propose a molding apparatus specifically for moldings with a stepped top side, in order to achieve uniform consolidation, clean mold removal and self-cleaning of the mold sections.

Starting from the molding apparatus initially designated, this aim is achieved according to the invention in that the stamp consists of two separate partial stamps guided in each other, the end cross-sectional areas of which are dimensioned so that one molds the lower-lying and the other the higher-lying top partial surfaces of the molding, that the stroke distance of the partial stamp for the higher-lying partial surfaces is limited relative to the other partial stamp in an upper consolidation position, in which both stamps conjointly reproduce the top side of the molding, and in a lower mold-removal position, by stops. Preferably, spring elements which are tensioned between the partial stamps press the partial stamp for the higher-lying partial surfaces into the mould-removal position.

Consequently, during the descent of the stamp the possibly spring-loaded part of the stamp already rests upon the molded material when the partial stamp for the lower-lying partial surfaces commences to penetrate into the molded material. However, the spring forces become fully effective only towards the end of the consolidation process, when the partial stamp for the lower-lying partial surfaces has already reached it limit position. However, even if no springs are provided, the delayed reaction of the partial stamp for the higher-lying partial surfaces substantially improves the consolidation in its region. On the other hand, satisfactory mold stripping and self-cleaning of the mold are obtained inasmuch as the partial stamp for the higher-lying partial surfaces remains behind on the molding whilst the other partial stamp is raised with the relaxation of the spring elements. This partial stamp therefore skims over the lateral surfaces of the raised part of the top side of the molding and smoothes the latter similarly as the molding box skims over and smoothes the lateral surfaces of the foundation of the molding.

If the molding apparatus is intended for a molding of the type illustrated in FIG. 1, or similar, then the stamp arrangement is preferably made so that the partial stamp for the lower-lying partial surfaces is a ring surrounding the other partial stamp. It is particularly proposed that the ring forms the lateral walls, and the other, particularly plate-shaped, partial stamp the bottom of a box-shaped stamp head, that guide pins attached to the partial stamp penetrate the roof of the stamp head, and that compression springs surrounding the guide pins are tensioned between roof and partial stamp. Such a comparatively compact stamp head is suitable particularly for use in customary commercial molding machines and in conjunction with the superimposed loads customary in the latter.

In order to give better guidance in the stroke direction to the plate-shaped partial stamp which molds the higher-lying partial surface, it is proposed as an alternative that the ring is connected by rods to a first superimposed load and that the other partial stamp supports a second superimposed load which is guided on the rods. In this case compression springs may be tensioned between the superimposed loads.

The two-part construction of the stamp creates a particular problem if the molding apparatus according to the invention is required to be used in a so-called multi-layer production machine. Thus is understood to mean a molding machine known per se, generally fully automatic in operation, which piles the fresh, still uncured concrete moldings one upon the other in layers on a transport pallet—wet on wet. In order to prevent any cohesion, particularly of the lower moldings under the load of the weight of the other ones, a little dry sand is optionally sprinkled between them. In any case, with this type of machine the moldings are stacked from the outset in transportable package units and cure in this way, whereby working space and storage facilities are economized, and above all the work processes which are otherwise involved to assemble the moldings, which are stored individually for curing, on transport pallets.

The peculiarity of the multi-layer production machine is that after the pressing and consolidation of the molding the vibrating table is removed, and in its place a pallet, possibly with moldings already deposited thereon, is brought beneath the mold, in order to deposit the last molding still present in the molding box upon it.

During this exchange the molding box is bottomless. The consolidated molding is retained solely by the vertical internal surfaces of the molding box by friction and adhesion. Although these retaining forces are sufficient to support the weight of the molding itself, they are insufficient to withstand in addition the weight of the inner partial stamp which molds the higher-lying partial surfaces and possibly the spring forces which act upon this partial stamp. In the absence of special measures, therefore, the consolidated molding would drop or be pressed out of the molding box when the vibrating table or other molding box bottom was removed.

It is therefore proposed as a further development of the invention that retaining elements are provided which automatically secure the partial stamp for the higher-lying partial surfaces immovably to the other partial stamp in the consolidation position, and that measures are adopted to release the retaining elements after the molding is supported by a storage supplied from underneath and before the upward movement of the partial stamp for the lower-lying partial surfaces commences during mold-removal.

The retaining elements may be, for example, pawls mounted rotatably on the outer partial stamp or other locking elements which self-engage by spring force and therefore absorb the weight of the inner partial stamp and the spring forces acting upon the latter. The molding therefore remains retained in the bottomless molding box during the exchange of the vibrating table for the pallet, as is known per se in the case of molds with one-part stamps. Control lugs which influence the locking elements during the raising of the molding frame are preferably provided in order to release the locking elements, that is to say in order to unlock the two partial stamps.

As a variant of such totally mechanical solutions, it is also possible to actuate the locking elements by pneumatic or hydraulic control cylinders or electrical lifting magnets, whilst these servomotors receive their signals at the correct time from the electrical control device of the molding machine. Powerful electromagnets may also be used as retaining elements, being attached to a partial stamp and retaining the other partial stamp firmly, directly by their tractive force.

Figure 2:
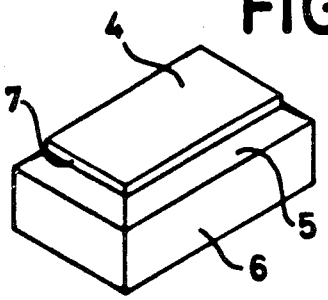
Figure 4:
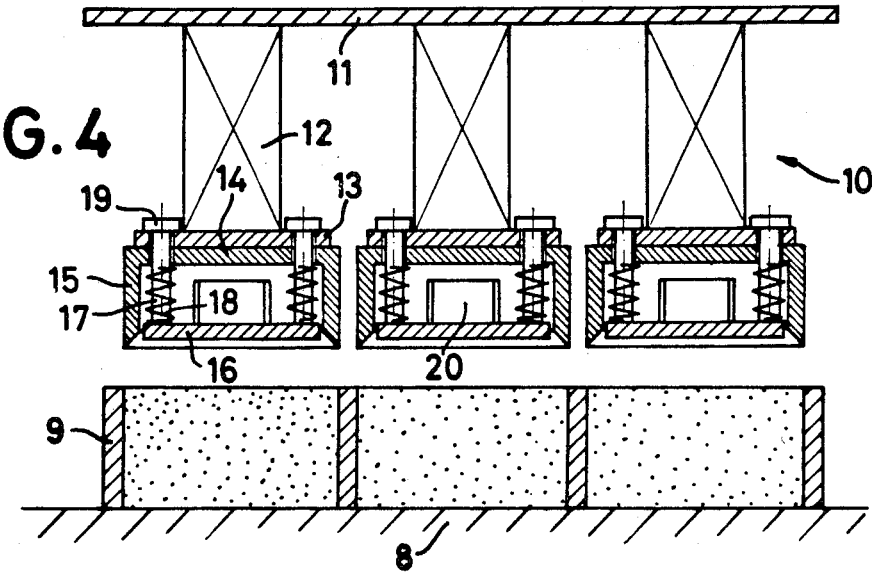
Figure 5:
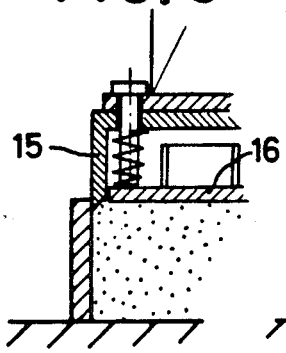
Figure 9:
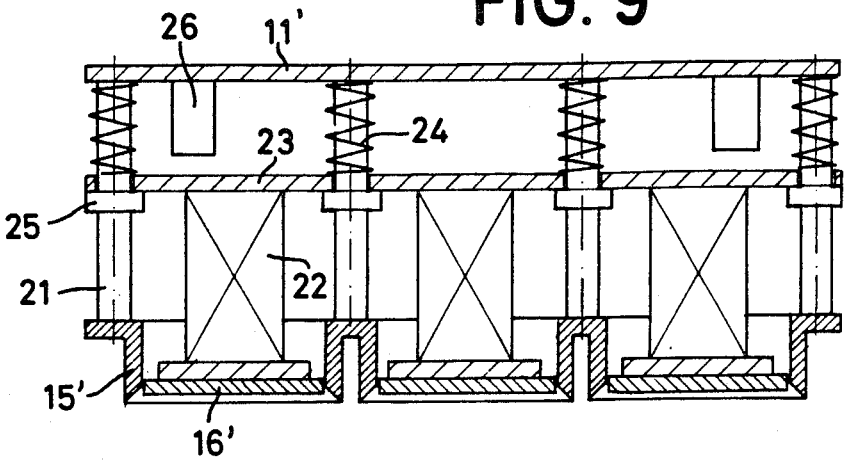
Figure 3:
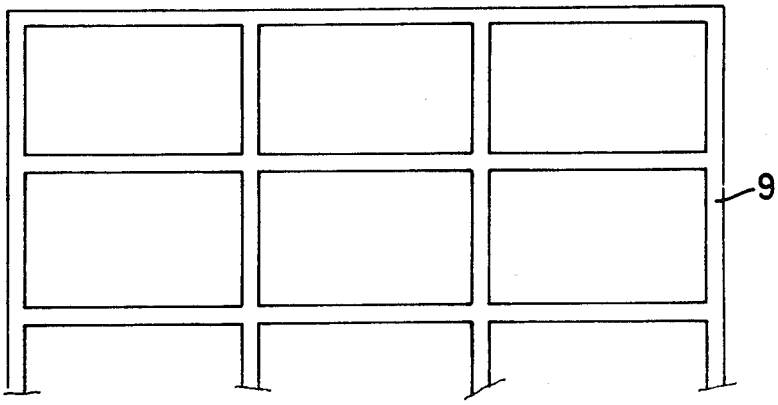
Figure 10:
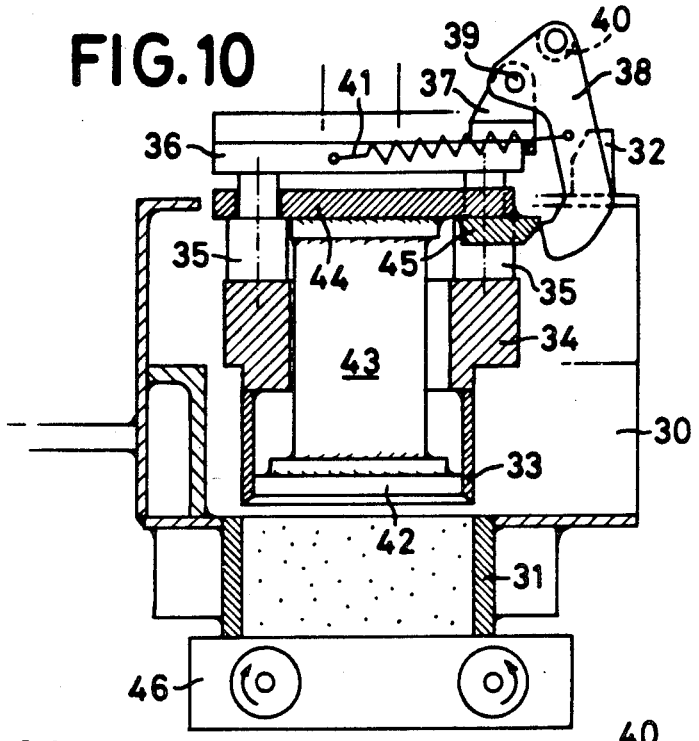
Figure 11:
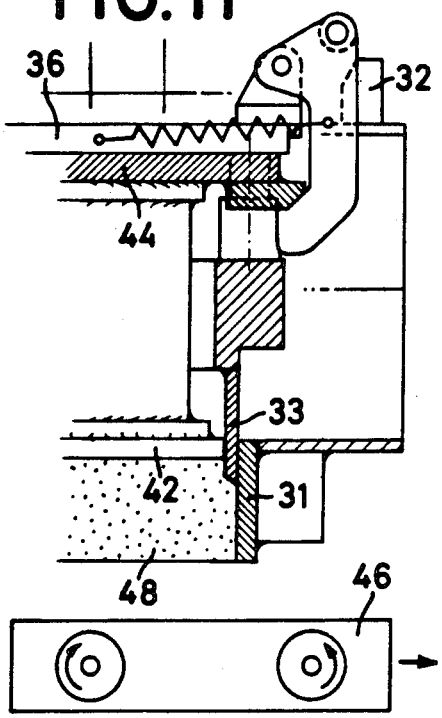
Figure 12:
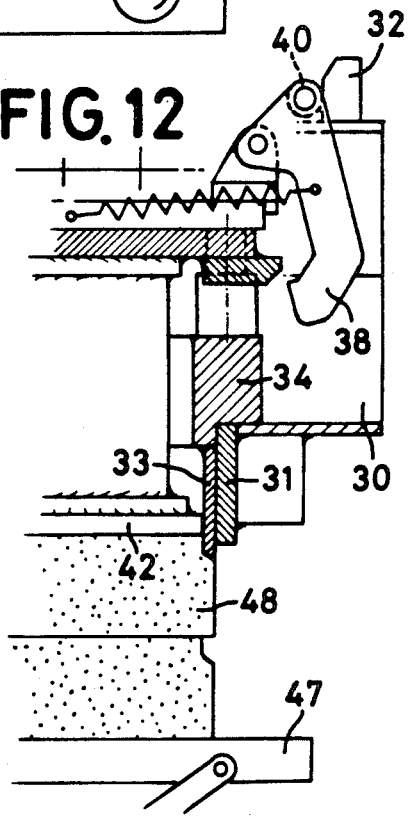

Two forms of construction of the invention are explained below with reference to the drawing, wherein specifically:

FIG. 1 shows a perspective view of a known interlocking paving stone made of concrete, FIG. 2 shows a perspective illustration of a molding, FIG. 3 shows a multiple-molding frame in plan, FIG. 4 shows a vertical section of a multiple-molding apparatus in the mold removal position, FIGS. 5 to 8 show partial sections of the molding apparatus as in FIG. 4 in different intermediate positions, FIG. 9 shows a vertical section of a second example of a multiple-molding apparatus, FIG. 10 a vertical section of a further molding apparatus with partial stamp locking for multi-layer production machines and FIGS. 11 and 12 show partial sections of the molding apparatus according to FIG. 10 in further intermediate positions.

The interlocking paving stone shown in FIG. 1 has a foundation with teeth 1 of trapezoidal cross-section, which interlock mutually during laying and give the stones a mutual grip. The face side consists of a central panel 2 with embossed surface, the contour line of which is deliberately drawn irregularly in order to create the impression of a hewn natural stone. The central panel 2 is surrounded on a lower step by a shoulder surface 3, which has a nonuniform width due to the teeth 1 and to the shape of the central panel 2 and slopes slightly outwards. In the finally laid stonework the central panels are surrounded by wide nonuniform false joints, which create an extremely rustic effect, although the foundations of the stones stand in a close structure and therefore have a high load capacity.

The molding shown in FIG. 2 serves only for a simpler graphical representation of the molding apparatus. Like the stone according to FIG. 1, it has as its typical features a raised central surface 4 and a depressed outwardly sloping shoulder surface 5, the central surface 4, however, being rectangular, the frame-shaped shoulder surface 5 being of equal width throughout and the lateral surfaces 8 of the foundation and 7 of the upstanding central section being plane.

The components of the molding apparatus to produce a molding according to FIG. 2, will be described with reference to FIGS. 3 and 4.

As is customary, the mold is a so-called multiple mold, with which a plurality of moldings can be produced in one movement cycle. A molding frame 9, which rests upon a molding table 8, forms individual square chambers and is taller than the molding. The movement mechanism for raising the molding frame 9 is not shown. The moving part of the molding machine to which the superimposed load, generally designated 10, is attached, is likewise absent from this illustration. The superimposed load consists in this case of an upper mounting plate 11, a stamp shank 12 for each stamp and a guide plate 13 attached to the lower end of each stamp shank. The detailed description of the stamp shank 12 is in conformity with the required weight.

Secured to each guide plate 13 is the roof 14 of a box-shaped stamp head, the lateral walls of which form the partial stamp, henceforth designated the stamp ring 15, to mold the shoulder surface 5. The lower edge of the stamp ring 15 is appropriately bevelled. A stamp plate 16, which corresponds in its dimensions to the central surface 4, serves as a movable bottom of the box-shaped stamp head. The stamp plate 16 is guided in the stroke direction by means of four guide pins 17 which are attached to the stamp plate 16 and slidingly penetrate the roof 14 and guide plate 13. The guide pins 17 are surrounded by coil springs 18, which act as compression springs and are braced against the roof 14 at the top and against the stamp plate 16 at the bottom. The latter is therefore pressed downwards relative to the stamp ring 15, this movement being limited by the heads 19 of the guide pins 17 acting as stops. A weight 20, which is attached to each of the stamp plates 16, limits the upward stroke movement of the stamp plate 16 by striking the roof 14.

Figure 6:
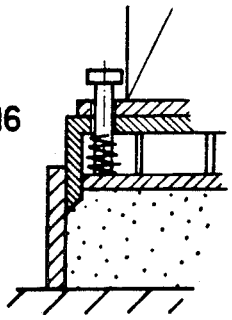

FIG. 4 illustrates the apparatus in the rest position when commencing the molding cycle. The molding frame 9 rests upon the molding table 8 and is charged with loose concrete and skimmed. Now when the superimposed load 10 with the stamp heads descends, the stamp plates 16 rest upon the concrete mass at first (FIG. 5), and subsequently the stamp rings 15 penetrate into their lower position limited by the molding machine (FIG. 6). This process is supported by vibrating the molding table 8 and/or the superimposed load 10. The vibrating movement is also transmitted to the stamp plate 16 and its weight 20, so that the stamp plate 16 descends to the stop during the final phase of the molding cycle.

Figure 7:
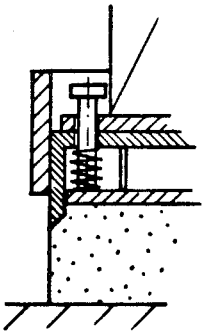
Figure 8:
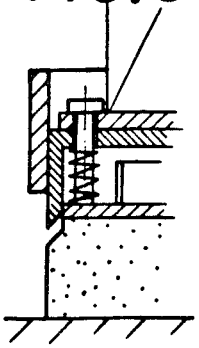

The mold removal is commenced by raising the molding frame into the position according to FIG. 7, whilst the stamp head remains resting on the molding. During further movement (FIG, 8), when the superimposed load 10 also moves upwards, although the stamp ring 15 travels with the latter, the stamp plate 16 remains rest-upon the central surface 4 with simultaneous relaxation of the springs 18. This causes the lateral surface 7 of the molding also to be skimmed smooth, so that it only remains to raise the stamp plate 16 as a final step.

In this manner clean mold removal is ensured and cleaning of the molding apparatus is normally unnecessary.

In the form of construction according to FIG. 9 a corresponding stamp ring 15' is connected by rods 21 to a corresponding mounting plate 11', which forms a first superimposed load conjointly with the rods. Stamp shanks 22, which are mutually connected by a guide plate 23, are attached to corresponding stamp plates 16'. This guide plate 23 is penetrated by the rods 21 and guided on the latter. Compression springs 24 are tensioned between the mounting plate 11' and the guide plate 23 and as a result press the stamp plates 16' downwards. Their downward stroke is limited by stop rings 25 on the rods 21 and by stop blocks 26 which are attached to the mounting plate 11'.

The principle of operation of the molding apparatus according to FIG. 9 corresponds to that according to FIG. 4, but this alternative provides better vertical guidance for the stamp plate 16', the springs 24 can be more strongly dimensioned and longer, because more space is available, and the weight influencing the stamp plate 16' can likewise be greater. The precise dimensioning of the weights and spring forces depends upon individual cases. In the second form of construction particularly, an adjusting device for the spring forces can immediately be accommodated.

The molding apparatus according to FIGS. 10 to 12 is to be interpreted generally only as a detail of a larger multiple-molding apparatus for, for example, 30 concrete paving stones. The actual molding box walls 31 are fitted underneath on a comparatively tall molding frame 30. A cam 32, which is bevelled at its left-hand corner, is welded onto the upper edge of the molding box. A stamp ring 33 is attached to a plate 34, which is firmly connected by guide bolts 35 to a mounting plate 36. The guide bolts 35 exhibit a lower part of larger diameter, which merges through a bearing shoulder into an upper part of smaller diameter. A bearing eye 37 of a pawl 38, which hangs downwards and can rotate about a journal 39, is mounted on the mounting plate 36. This pawl has a backwardly projecting stay bolt 40 at the top. A traction spring 41 draws it to the left. The pawl 38 is therefore mounted on the subassembly supporting the stamp ring 33.

Opposite this subassembly, a further subassembly comprising a stamp plate 42, a stamp shank 43 and a guide plate 44, is movable up and down. The guide bolts 35 penetrate the guide plate 44 with play. A plate-shaped pawl tooth 45, which cooperates with the pawl 38, is welded on beneath the right-hand edge of the guide plate 44. No spring elements are provided between the two subassemblies supporting the stamp parts in this example. The arrangement described functions as follows: according to FIG. 10 the molding box 31, charged with concrete and skimmed, rests upon a vibrating table 46. The stamp arrangement is descending above the latter. The subassembly 42, 43, 44 occupies its lowest position relative to the subassembly 33 to 36. The guide plate 44 rests upon the support shoulder of the guide bolts 35. The pawl 38 is disengaged.

Now when, in the course of the downward movement, the stamp ring 33 penetrates into the moulding box, the stamp plate 42 escapes upwards relative to the stamp ring 33. When the stamp ring 33 has reached its lowest position the guide plate 44 connected to the stamp plate 42 abuts the mounting plate 36. In this position the spring 41 draws the pawl 38 beneath the pawl tooth 45. FIG. 11 illustrates this position. The consolidation process is now complete and the vibrating table 46 can be moved away, which is likewise indicated in FIG. 11. The molding 48 is now unsupported from beneath. It merely "hangs" in the moulding box by adhesion.

When the vibrating table 46 has been removed, in its placed a pallet 47, upon which a layer of moldings has already been deposited for example, is transported under the stationary mold and gently raised so that the surface of the previously produced molding just touches from beneath the molding still present in the mold. The mold removal now commences. The molding frame 30 commences to move upward. After a specific stoke the oblique edge of the cam 32 strikes against the stay bolt 40 of the pawl 38 and imparts to the latter a rotary movement to the left counter to the spring force. The lower end of the pawl then pivots to the right and releases from the pawl tooth 45, as shown in FIG. 12. The moulding frame 30 then continues to move upward until the lower edge of the molding box wall 31 has passed the lower edge of the stamp ring 33 and the molding frame strikes against the plate 34. The stamp ring 33 is now entrained and ultimately also the stamp plate 42, as soon as its guide plate 44 rests upon the bearing shoulder of the guide bolt 35.

We claim:

1. An apparatus for producing moldings from concrete et cetera, particularly concrete paving stones and lawn stepping stones, the top side of which exhibits partial surfaces of different vertical level, with a molding table, with a molding frame and with a stamp fitted in the latter, guided movably at right angles to the molding table and provided with a superimposed load, wherein the stamp consists of two separate partial stamps (15,16) guided in each other, the end cross-sectional areas of which are dimensioned so that the one molds the lower-lying (5) and the other the higher-lying top partial surfaces (4) of the molding, and that the stroke distance of the partial stamp (16) for the higher-lying partial surfaces (4) is limited relative to the other partial stamp (15) in a upper consolidation position, in which both partial stamps (15,16) conjointly reproduce the top side of the molding, and in a lower mold-removal position, by stops (19,20).

2. An apparatus as claimed in claim 1, wherein spring elements (18) which are tensioned between the partial stamps (15,16) press the partial stamp (6) for the higher-lying partial surfaces (4) into the mold-removal position.

3. An apparatus as claimed in claim 1, wherein the partial stamp for the lower-lying partial surface (5) is a ring (15) surrounding the other partial stamp (16).

4. An apparatus as claimed in claim 3, wherein the ring (15) forms the lateral walls and the other, particularly plate-shaped, partial stamp (16) forms the bottom of a box-shaped stamp head, whilst guide pins (17) attached to the partial stamp (16) penetrate the roof (14) of the stamp head and whilst compression springs (18) surrounding the guide pins (17) are tensioned between roof (14) and partial stamp (16).

5. An apparatus as claimed in claim 3, wherein the ring (15') is connected by rods (21) to a first superimposed load (11'), whilst the other partial stamp (16') supports a second superimposed load (22,23) which is guided on the rods (21).

6. An apparatus as claimed in claim 1, wherein retaining elements (38) are provided which automatically secure the partial stamp (42) for higher-lying partial surfaces immovably to the other partial stamp (33) in the consolidation position, whilst measures are adopted to release the retaining elements (38) after the molding (48) is supported by a storage surface applied from underneath and before the upward movement of the partial stamp (33) for the lower-lying partial surfaces commences during mold removal.

7. An apparatus as claimed in claim 6, wherein the retaining elements (38) are locking elements mounted on the partial stamp (33,34,35,36) for the lower-lying partial surfaces, which drop automatically into the locking position.

8. An apparatus as claimed in claim 7, wherein control lugs (32) are provided on the mold frame (30) to release the locking elements during the raising of the mold frame relative to the partial stamp (33) for the lower-lying partial surfaces.

* * * * *